US005311211A

United States Patent [19]

Simpson

[11] Patent Number: 5,311,211

[45] Date of Patent: May 10, 1994

[54] APPARATUS AND METHOD FOR PROVIDING A RASTER-SCANNED DISPLAY WITH CONVERTED ADDRESS SIGNALS FOR VRAM

[75] Inventor: Richard D. Simpson, Bedminster, N.J.

[73] Assignee: Texas Instruments Incorporated, Dallas, Tex.

[21] Appl. No.: 765,623

[22] Filed: Sep. 25, 1991

[30] Foreign Application Priority Data

Oct. 9, 1990 [GB] United Kingdom ..... 9021920.5

[51] Int. Cl.[5] ..... G09G 1/02

[52] U.S. Cl. ..... 345/189; 345/185

[58] Field of Search ..... 360/799, 798, 750; 364/521

[56] References Cited

U.S. PATENT DOCUMENTS

| | | | |
|---|---|---|---|
| 4,591,850 | 5/1986 | Lundstrom | 340/750 |
| 4,617,564 | 10/1986 | Yoshioka | 340/799 |
| 4,755,810 | 7/1988 | Knierim | 340/799 |
| 4,920,504 | 4/1990 | Sawada et al. | 340/799 |
| 4,935,880 | 6/1990 | Kelleher et al. | 340/799 |
| 4,951,230 | 8/1990 | Dalrymple et al. | 340/799 |
| 4,958,302 | 9/1990 | Fredrickson | 364/521 |

*Primary Examiner*—Ulysses Weldon
*Assistant Examiner*—Matthew Luu
*Attorney, Agent, or Firm*—William E. Hiller; Richard L. Donaldson

[57] ABSTRACT

Method and apparatus of providing a display on a raster-scanned screen (1) from data stored in a video random access memory (8) having row and column addresses (6,7) for the storage elements, wherein the display area of the screen (1) is divided into a plurality of identical rectangular areas or "tiles". Addressing of the video random access memory (8) is derived by converting the screen raster-scanning signals via conversion circuits (5) such that sequential addressing of entire rows of storage elements of the video random access memory (8) corresponds to a description of all of the rectangular areas in turn, wherein the number of rectangular areas across the screen width is not equal to an integral power of 2.

9 Claims, 1 Drawing Sheet

APPARATUS AND METHOD FOR PROVIDING A RASTER-SCANNED DISPLAY WITH CONVERTED ADDRESS SIGNALS FOR VRAM

This invention relates to raster-scanned displays and is especially but not exclusively valuable for use with graphics displays such as might be produced by a computer, for example.

Raster-scanned displays are familiar to most people in the form of television pictures and are in most instances produced by causing one or more electron beams each focused to a small spot, to scan a succession of closely-spaced, parallel, horizontal lines on a fluorescent screen of a cathode ray tube, while the intensity of the or each beam is modulated so as the change the brightness and-/or colour of the picture elements (pixels) as the beam(s) scans through them. Other types of display device, for example a liquid crystal array, can be used to produce a raster-scanned display. Whereas the video information modulating the beam(s) to produce a television picture is produced continuously from a received or recorded signal, when the display is of the output from a digital computer, the data for modulating the beam(s) to control the brightness and/or colour of the individual picture-elements are stored in a digital data store, usually a VRAM (video random access memory), and are read out in the sequence required to produce the display.

The output from a digital computer may take the form of a graphics display, for example a drawing of some kind, and it has been found that for certain types of graphics display the amount of data processing required is sufficient for it to be necessary to provide an additional processor just to generate the data required to produce the display from the computer output. With the increasing complexity and sophistication of the displays, it is being found that more and more powerful processors are required to produce the displays. It is, of course, desirable that a display should be produced without appreciable delay, and a significant part of the time required to generate a display arises from the access time of the VRAM used to store the data for the display. The address information for a VRAM consists of a row address and a column address and it is a feature of this kind of memory that a succession of column addresses with the same row address can be accessed relatively quickly, whereas the accessing of different addresses having different row addresses takes much longer, typically four times as long.

That characteristic of VRAM's is conventionally utilised in generating raster scanned displays by reading all of the column addresses at one row address and then all of the column addresses at the next row address and so on, in that way the fewest changes of row address are made and the memory is operated at the highest possible speed in feeding data to the display.

When producing a graphics display, the method just described of using VRAM's has the disadvantage that the entering of data into the memory can require a lot of changes of row address. Suppose, for example, that the rows of the memory corresponded respectively to the lines of the display raster. In such an arrangement the drawing of a horizontal line on the display could be done quickly by accessing the successive column addresses at the same row address corresponding to the picture elements of the horizontal line. On the other hand, the drawing of a line at any other angle would call for the accessing of at most a few column addresses at each of a number of different row addresses, which would be much more time consuming than drawing a horizontal line.

One way that has been proposed to reduce the amount of time needed to produce a graphics display, in particular diagonal and vertical lines, is to divide the area of the display screen into so-called tiles. A tile is an area of the screen which has a vertical height of several lines, for example 4 lines or 8 lines, and a horizontal length which is an integral sub-multiple of the screen width, for example one eighth of that width.

The rows of the VRAM are allocated respectively to the tiles of the display screen and the columns of the VRAM are allocated respectively to the positions of picture elements in a tile. When lines other than horizontal are to be drawn the number of changes of row address required to enter the data in the VRAM are reduced by a factor equal to the number of lines in a tile. Entering the data for a horizontal line may require one or more changes of row address depending on its length, but that additional time is more than compensated for by the savings when drawing other than horizontal lines.

Of course, reading the data from a VRAM organised to produce a tiled display will incur additional changes of row address compared with the conventional arrangement, but access times of VRAM's are now so short that those additional changes of row addresses do not interfere with the transfer of data from the memory to the display screen at normal display rates.

Provided that the number of picture elements in a whole scanning line, the so-called horizontal pitch of the display, is equal to an integral power of two, and similarly the number of tiles across the screen width is also an integral power of two, then the X, Y address coordinates of a picture element in a tile can be obtained from the linear address in the display digital data store where the data for that picture element are stored, and vice versa, by simply interchanging certain bits of the addresses.

It is not always convenient or practical to select the horizontal pitch and the number of tiles across the screen width to be integral powers of two. For example, having 512 picture elements per line represents quite a low definition and not adequate for reproducing 80 characters per line. Whilst 1024 picture elements per line is medium to high definition and is fine for reproducing 80 characters per line, there are certain graphics displays for which it is too coarse. On the other hand, providing 2048 picture elements per line is approaching the present, upper practical limit for definition and is extremely expensive to implement.

One possible approach to the problem of providing a horizontal pitch which is not an integral power of two is to have a virtual screen with a pitch equal to an integral power of two and to display only part of the width of the virtual screen. A disadvantage with that approach is that the display store must be of the same size in terms of picture elements as the virtual screen, with the consequence that a lot of expensive storage capacity is wasted, for example up to 40% of the total display store.

It is an object of the present invention to provide an improved display apparatus.

According to one aspect of the present invention there is provided display apparatus including a display device having a screen, scanning circuits for producing a scanning raster on the screen of the display device, video random access memory means having an output channel connected to supply data to the display device, and an input channel for data to be stored in the memory means, addressing means for the memory means, and conversion circuits responsive to signals from the scanning circuits representing the picture elements being scanned to produce address signals for application to the addressing means to cause the memory means to supply the data for the picture element being scanned, the conversion circuits being such that sequential addresses of the memory means correspond to sections of the scanning lines of the raster containing an integral power of two of picture elements, the sections forming identical rectangular areas of the screen having a width equal to an integral submultiple of the screen width and a height of an integral power of two of consecutive scanning lines, wherein the width of the identical rectangular areas of the screen is equal to the width of the screen divided by a number other than an integral power of two.

According to a second aspect of the present invention there is provided a method of providing a display on a raster-scanned screen from data stored in a video random access memory having row and column addresses for the storage elements in which the display area of the screen is divided into a plurality of identical rectangular areas, each having a height of an integral power of two scanning lines and a width of an integral submultiple of the screen width, and the addressing of the video random access memory is derived by conversion from the screen raster-scanning signals so that sequential addressing of entire rows of storage elements of the video random access memory corresponds to description of the whole of each of the rectangular areas in turn, there being a number other than a power of two of the rectangular areas across the screen width.

The video random access memory may have inputs for row and column addresses and may be such that the access time of a storage element having the same row address as the storage element accessed immediately previously is much shorter than the access time of a storage element not having the same row address as the storage element accessed immediately previously, with the row addresses respectively corresponding to the rectangular areas of the screen or to groups of adjacent rectangular areas and the column addresses respectively corresponding to picture element positions in a rectangular area or groups of rectangular areas.

The conversion may involve forming for each picture element the row address from the sum of a number formed by the digits of more significance of the position of the particular picture element along a line of the scanning raster and the product of the number of rectangular areas across the screen width times a number formed by the digits of more significance of the number of the line on which the particular picture element lies. In that conversion the column address of a picture element is given by the concatenation of the digits of less significance of the number of the line on which the particular picture element lies with the digits of less significance of the position of the particular picture element on the line. The partitions of the digits of the number of the line, and the number representing the position of the picture element along a line, into more and less significance take place at places corresponding to the height in number of lines and width in picture element positions of a rectangular area.

In this specification the rectangular areas of the screen are termed tiles.

The row address of the storage element storing data for a particular picture element may be equal to a number allocated to the tile or group of tiles containing that picture element. The column address of the storage element storing data for a particular picture element may be a number allocated to the position of that picture element in a tile or group of tiles.

As mentioned above, the row and column addresses of the storage element storing data for a particular picture element having coordinate values X and Y on the screen may be derived from those coordinate values by dividing them into parts of more significance and parts of less significance at places corresponding to the width and height of a tile and combining the parts. The row address may be equal to the sum of the more significant part of the Y value (identifying the row of tiles on the screen) multiplied by the number of tiles across the screen and the more significant part of the X value (identifying which tile in the row). The column address may be the concatenation of the less significant part of the Y value (identifying the scanning line in the tile) and the less significant part of the X value (identifying the position of the picture element along the part of the scanning line).

Each tile may have a width of 256 pixels and a height of 4 lines, and the screen width may be 1280 pixels so that there are 5 tiles across the screen. If the X and Y coordinate values have 16 bits, then the $$\text{row address} = Y(15-2)*5+X(15-8) \text{ and the}$$

$$\text{column address} = Y(1-0)::X(7-0),$$

where $Y(15-2)$ means bits 15, 14,—, 3, 2, of the Y value, $Y(1-0)$ means bits 1 and 0 of the Y value, $X(15-8)$ means bits 15, 14,—, 9, 8, of the X value, $X(7-0)$ means bits 7, 6,—, 1, 0, of the X value,

* means multiplication (to avoid confusion between a conventional multiplication sign and X), and :: means concatenation.

Not all possible 16-bit numbers need be used to represent the X and Y coordinate values on the screen, and in most cases will not be used.

An example of display apparatus will now be described with reference to the accompanying drawings of which:

The following description will refer to those drawings.

Figure 1:
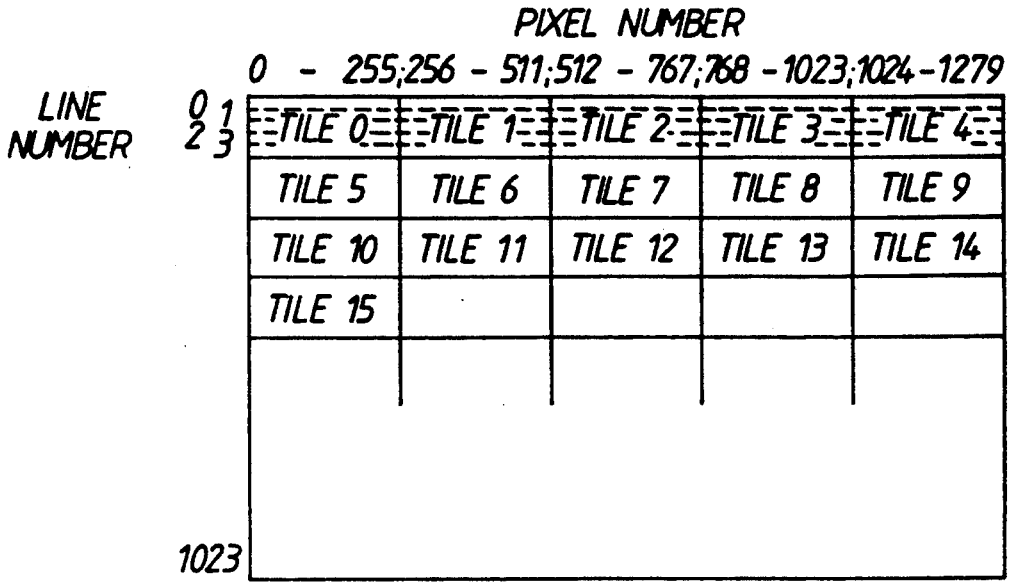
FIG. 1 shows the sub-division of a display screen into rectangular areas (tiles)

FIG. 1 shows an example of a display screen divided into tiles, in which the screen has a pitch of 1280 pixels per line and 1024 lines per frame. Each tile extends over a vertical height of 4 lines, with 256 pixels in each line, so that the display area contains 1280 tiles.

Figure 2:
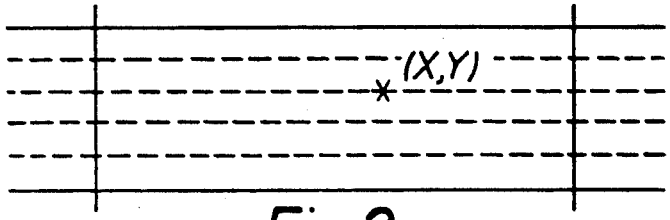
FIG. 2 shows a single rectangular area (tile) in more detail.

FIG. 2 shows one of the tiles enlarged with one pixel selected, having a screen address (X,Y). The origin of the screen coordinates is the top left-hand corner. For convenience in any calculations which may need to be done by a display processor, the address coordinates are expressed as 16-bit numbers, for example X(15−0), Y(15−0).

As the screen is scanned using a raster, the values of the X- and Y- deflections repeatedly follow linear increases to respective maximum values and then rapidly return to zero again, the repetition rate for the X-deflection being 1024 times the repetition rate for the Y-deflection in the present example. The (X,Y) coordinate values can readily be obtained from the deflection circuits.

The identity of the tile containing the pixel (X,Y) and the position of the pixel (X,Y) within the tile will now be derived from the (X,Y) coordinate values.

Because each tile is 256 pixels wide and contains pixels in 4 consecutive lines, it follows that the lower 8 bits of the X value will identify the position of the pixels along a section of a line in a tile, and the 2 bits of least significance of the Y value will identify on which of the 4 lines in a tile the pixel lies. The position can be reduced to a single 10-bit number by concatenating together the 2 bits from the Y value with the 8 bits from the X value. This may be expressed:

$$\text{position of a pixel within a tile} = Y(1-0)::X(7-0).$$

As shown in FIG. 1, the display screen has five tiles across its width, each tile having a vertical height of four lines. The tiles numbered 0 to 4 occupy the uppermost row, tiles 5 to 9 the second row, and so on. From that data it can be shown that the pixel (X,Y) is located in the tile numbered Y(15−2)*5+X(15−8), where Y(15−2) represents the line number less the 2 bits of least significance, * represents multiplication (to avoid confusion with the X coordinate value), and X(15−8) represents the pixel number in a line less the eight bits of lower significance.

In order to make use of the division of the area of the screen into tiles to reduce the number of changes of row address of the VRAM during the generation of a graphics display on the screen, the tile number is used as the row address of the VRAM and the position of the pixel within a tile is used as the column address of the VRAM.

In a typical application each pixel needs several bits of data to be stored in the VRAM in order to permit the pixel to have a range of different brightness levels, and a range of different colours. In one example 16 bits were allocated to each pixel, providing 5 bits (32 values) for the brightness of each of the three colours (red, green, blue) of the display and a further bit to indicate whether or not the pixel should flash. One way in which the 16 bits could be provided for each pixel is to use 16 separate integrated circuits in parallel as the VRAM.

Figure 3:
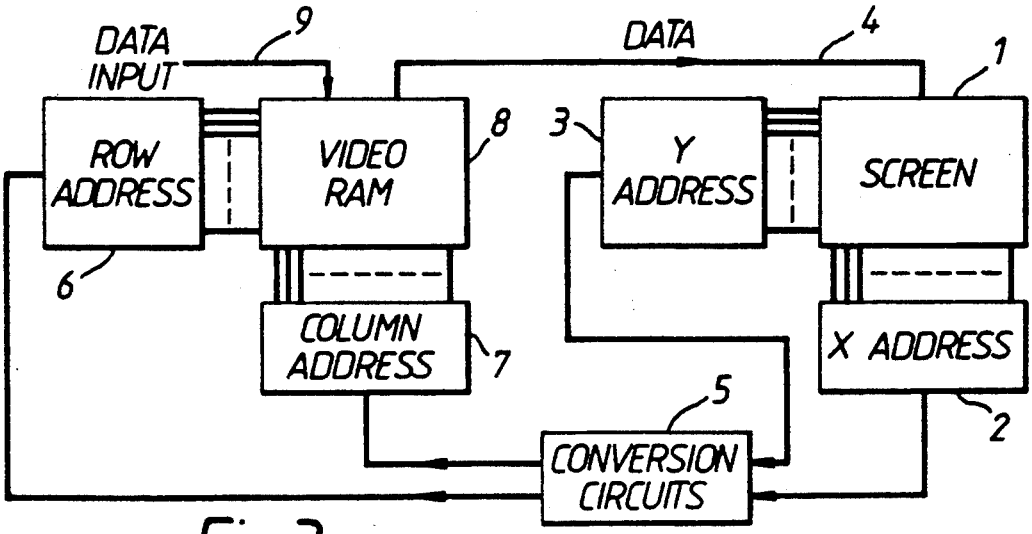
FIG. 3 is a block diagram of the example of display apparatus.

FIG. 3 shows in diagrammatic form an example of a raster-scanned display screen connected to receive data to be displayed from a video RAM. In FIG. 3, a display screen 1 executes a raster scan in response to X address circuit 2 and Y address circuit 3 to produce a display of data received along a channel 4. In practice, the screen 1 may be a cathode ray tube with conventional line and frame sawtooth generators. The X and Y address circuits 2 and 3 produce multibit numbers representing the X and Y coordinates of the pixel being produced at the time (or the X and Y deflections of the electron beam of the cathode ray tube), and those multibit numbers are applied to conversion circuits 5.

The conversion circuits 5 produce as outputs row and column addresses which are respectively applied to row address circuits 6 and column address circuits 7 of a video RAM 8. The data read from the VRAM 8 are applied over the channel 4 to the screen 1. Input data to the VRAM 8 are fed in along a channel 9.

For the arrangement shown in FIG. 3 to produce a tiled display as described above with reference to FIGS. 1 and 2, the numbers produced by the X and Y address circuits 2 and 3 have 16 bits and are the numbers X(15−0) and Y(15−0) mentioned above, those numbers being the coordinates of a pixel on the screen 1. The conversion circuits 5 receive the numbers X(15−0) and Y(15−0) from the address circuits 2 and 3 and produce from those numbers the numbers Y(15−2)*5+X(15−8) and Y(1−0) :: X(7−0) respectively representing the number of the tile and the position of the pixel within the tile, the latter numbers being used as the row address and the column address respectively of the VRAM 8. The multiplication by 5 to produce the row address may be achieved by adding the multiplicand to itself shifted two places to the left.

In the example described above, the tiles have a vertical height of four lines. In another example the tiles have a vertical height of eight lines, which means that the position of a pixel in a tile (the column address) becomes Y(2−0)::X(7−0) because the additional four lines over the earlier example requires an additional bit to describe the pixel position. With the allocation of a third bit of the Y number to the column address, the tile number (the row address) must be changed to Y(15−3)*5+X(15−8).

In the general case, using M bits to describe the X coordinate and N bits to describe the Y coordinate on the screen, the row and column addresses become $$Y([N-1]-P)*S+X([M-1]-R)$$

$$\text{and } Y([P-1]-0) :: X([R-1]-0)$$

for a division of the area of the screen into rows of S tiles each having a width of R bits and a height of $2^P$ lines. Preferably the number S is equal to the sum of two different powers of two so that the multiplication can be achieved by shifting and adding once.

In practice, a typical VRAM integrated circuit when operated in so-called page mode provides a 16-bit parallel output. A bank of VRAM integrated circuits contains sufficient integrated circuits to provide for each 2 pixels of the display a 64-bit parallel output, each pixel having 32 bits. In the example described above using tiles having a width of 256 pixels and a height of 4 lines, the size of tile is selected to be compatible with 4 megabit VRAM's. In a 4 megabit VRAM the number of binary storage elements is $2^{22}$ and in page mode (16- bit parallel) provides 256k addresses ($k=1024=2^{10}$). Assuming that the storage elements are in a square array, 512×512, each row will provide data for 256 pixels, and therefore a bank (4) of the VRAM's with provide data for a tile having 256×4 pixels.

If a tile is 8 lines instead of 4 lines in height then an 11-bit column address is required, the bit Y(2) being transferred from the row address to the column address for switching between the 2 banks of VRAM's which are required. If there is no timing problem in switching between the 2 banks of memories then the least significant bit of the column address could be used as a CAS enable signal, so as to place alternate lines in alternate banks. On the other hand, if there is a timing problem in switching between the banks, the changeover between the banks could be made every 4 lines, say, so as to reduce the effect of that problem.

The address manipulation described above does not take into account the fact that a VRAM is orqanised into two halves, each connected for parallel transfer of a group of bits into the stages of a serial data register respective to the half of the RAM and from which register the bits of the group are read out in series. Because of that organisation of the VRAM it is necessary to transfer from the two halves alternately in order to maintain a steady stream of bits from the serial data registers. In order to accommodate the organisation of the VRAM as just described it is necessary to do some further manipulation of the addresses. One way in which that could be done is to add an extra bit to the column address at its more significant end, the extra bit being the exclusive-OR of the previously most significant bit of the column address and the least significant bit of the row address. The effect of that further manipulation is to change the mapping of linear addresses on the screen from:

| | | | | |
|---|---|---|---|---|
| 0 — 0FF . | 400 — 4FF . | 800 — 8FF . | C00 — CFF . | 1000 — 10FF |
| 100 — 1FF . | 500 — 5FF . | 900 — 9FF . | D00 — DFF . | 1100 — 10FF |
| 200 — 2FF . | 600 — 6FF . | A00 — AFF . | E00 — EFF . | 1200 — 12FF |
| 300 — 3FF . | 700 — 7FF . | B00 — BFF . | F00 — FFF . | 1300 — 13FF |
| 1400 — 14FF . | 1800 — 18FF . | 1C00 — 1CFF . | . . . | |
| 1500 — 15FF . | 1900 — 19FF . | 1D00 — 1DFF . | | |
| 1600 — 16FF . | 1A00 — 1AFF . | : | | |
| 1700 — 17FF . | 1B00 — 1BFF . | : | | |

to: -

| | | | | |
|---|---|---|---|---|
| 0 — 0FF . | 600 — 6FF . | 800 — 8FF . | E00 — EFF . | 1000 — 10FF |
| 100 — 1FF . | 700 — 7FF . | 900 — 9FF . | F00 — FFF . | 1100 — 11FF |
| 200 — 2FF . | 400 — 4FF . | A00 — AFF . | C00 — CFF . | 1200 — 12FF |
| 300 — 3FF . | 500 — 5FF . | B00 — BFF . | D00 — DFF . | 1300 — 13FF |
| 1600 — 16FF . | 1800 — 18FF . | 1E00 — 1EFF . | . . . | |
| 1700 — 17FF . | 1900 — 19FF . | 1F00 — 1FFF . | | |
| 1400 — 14FF . | 1A00 — 1AFF . | : | | |
| 1500 — 15FF . | 1B00 — 1BFF . | : | | |

Although the invention has been described with reference to certain specific examples it is not limited to those examples. For example, the row capacity of the VRAM does not have to be equal to the number of picture elements in a tile, but it may be equal to the number of picture elements in a small plurality, e.g. 2, 3 or 4, of tiles adjacent to each other across the screen.

I claim:

1. Display apparatus including a display device having a screen, scanning circuits for producing a scanning raster on the screen of the display device, video random access memory means having an output channel connected to supply data to the display device, and an input channel for data to be stored in the memory means, addressing means for addressing the memory means, and conversion circuits responsive to signals from the scanning circuits representing the picture elements being scanned to produce address signals for application to the addressing means to cause the memory means to supply the data for the picture element being scanned, the conversion circuits being such that sequential addresses of the memory means correspond to sections of the scanning lines of the raster containing an integral power of two of picture elements, the sections forming identical rectangular areas of the screen having a width equal to an integral submultiple of the screen width and a height of an integral power of two of consecutive scanning lines, wherein the width of the identical rectangular areas of the screen is equal to the width of the screen divided by a number other than an integral power of two.

2. Display apparatus according to claim 1 wherein the video random access memory means has inputs for row and column addresses and is such that the access time of a storage element of the memory means having the same row address as the storage element accessed immediately previously is much shorter than the access time of a storage element having a different row address, and the row addresses correspond respectively to the rectangular areas or to groups of adjacent rectangular areas and the column addresses respectively corresponding to picture element positions in a rectangular area or groups of rectangular areas.

3. Display apparatus according to claim 2 wherein the conversion circuits are such that for each picture element the row address is the sum of a number formed by the digits of more significance of the position of the particular picture element along a line of the scanning raster and the product of the number of rectangular areas across the screen times a number formed by the digits of more significance of the number of the line of the scanning raster on which the particular picture element lies, and the column address is formed by the concatenation of the digits of less significance of the number of the line of the scanning raster on which the particular picture element lies and the digits of less significance of the position of the particular picture element along a line of the scanning raster.

4. Display apparatus according to claim 3 wherein the row address and the column address respectively of data in the video random access memory means for a picture element (X,Y) on the screen are $$Y([N-1]-P)*S+X([M-1]-R)$$

$$\text{and } Y([P-1]-0) :: X([R-1]-0)$$

where the X coordinate value is expressed in M bits and the Y coordinate value in N bits, $X([M-1]-R)$ representing the more significant bits (above the $R^{th}$ bit) of the X coordinate value, X([R−1]−0) representing the less significant bits (up to and including the $R^{th}$ bit) of the X coordinate value, Y([N−1]−P) representing the more significant bits (above the $P^{th}$ bit) of the Y coordinate value, and Y([P−1]−0) representing the less significant bits (up to and including the $P^{th}$ bit) of the Y coordinate value, each rectangular area covering $2^P$ scanning lines and R picture elements in each of those lines, there being S rectangular areas across the width of the screen, and the symbol * signifying multiplication and the symbol :: concatenation.

5. A method of providing a display on a raster-scanned screen from data stored in a video random access memory having row and column addresses for the storage elements in which the display area of the screen is divided into a plurality of identical rectangular areas, each having a height of an integral power of two scanning lines and a width of an integral submultiple of the screen width, said method comprising:

producing signals representative of picture elements in a scanning raster on the screen;

converting signals from the scanning raster representative of the picture elements being scanned to produce address signals such that sequential addressing of entire rows of storage elements of the video random access memory corresponds to a description of the whole of each of the rectangular areas in turn, there being a number other than a power of two of the rectangular areas across the screen width; and addressing the video random access memory based upon the conversion of signals from the scanning raster.

6. A method according to claim 5 further including providing numbers respectively allocated to the rectangular areas as the row addresses of the video random access memory and providing numbers respectively allocated to the positions of picture elements in a rectangular area as the column addresses of the video random access memory.

7. A method according to claim 6 wherein the conversion of signals from scanning raster provides addressing signals for the video random access memory is such that for each picture element the row address is formed as the sum of a number formed by the digits of more significance of the position of the particular picture element along a line of the scanning raster and the product of the number of rectangular areas across the width of the screen times a number formed by the digits of more significance of the number of the line of the scanning raster on which the particular element lies, and the column address is formed by concatenation of the digits of less significance of the number of the line of the scanning raster on which the particular picture element lies and the digits of less significance of the position of the particular picture element along a line of the scanning raster.

8. A method according to claim 7 further including partitioning the digits of the position of the particular picture element along a line of the scanning raster into digits of more significance and digits of less significance corresponding to the number of picture elements across a rectangular area, and partitioins the line number into digits of more significance and digits of less significance corresponding to the number of lines of the scanning raster in a rectangular area.

9. A method according to claim 8 further including defining the row address and the column address respectively of data in the video random access memory for a picture element (X,Y) on the screen by $$Y([N-1]-P)*S+X([M-1]-R)$$

$$\text{and } Y([P-1]-0) :: X([R-1]-0)$$

where the X coordinate value is expressed in M bits and the Y coordinate value in N bits, X([M−1]−R) representing the more significant bits (above the $R^{th}$ bit) of the X coordinate value, X([R−1]−0) representing the less significant bits (up to and including the $R^{th}$ bit) of the X coordinate value, Y([N−1]−P) representing the more significant bits (above the $P^{th}$ bit) of the Y coordinate value, and Y([P−1]−0) representing the less significant bits (up to and including the $P^{th}$ bit) of the Y coordinate value, each rectangular area covering $2^P$ scanning lines and R picture elements in each of those lines, there being S rectangular areas across the width of the screen, and the symbol * signifying multiplication and the symbol :: concatenation.

* * * * *